US005387963A

United States Patent [19]

Kajimoto et al.

[11] Patent Number: 5,387,963

[45] Date of Patent: Feb. 7, 1995

[54] ONE-COMPONENT DEVELOPING DEVICE

[75] Inventors: Masashi Kajimoto; Yutaka Toyoda; Hidekiyo Tachibana; Mikio Yamamoto, all of Kanagawa, Japan

[73] Assignee: Fuji Xerox Co., Ltd., Tokyo, Japan

[21] Appl. No.: 171,604

[22] Filed: Dec. 22, 1993

[30] Foreign Application Priority Data

Dec. 28, 1992 [JP] Japan ..... 4-358681

[51] Int. Cl.[6] ..... G03G 21/00

[52] U.S. Cl. ..... 355/215; 355/245; 355/269; 355/270; 355/296

[58] Field of Search ..... 355/245, 215, 259, 260, 355/269, 270, 214, 296, 298, 297, 363; 118/652

[56] References Cited

U.S. PATENT DOCUMENTS 5,223,668 6/1993 Takaya et al. ..... 355/259 X

FOREIGN PATENT DOCUMENTS 47-13088 7/1972 Japan .
53-30339 8/1976 Japan .
0170868 9/1984 Japan ..... 355/215
62-251771 11/1987 Japan .
1-49945 10/1989 Japan .
2-127669 5/1990 Japan .
4-100073 4/1992 Japan .

*Primary Examiner*—Matthew S. Smith
*Attorney, Agent, or Firm*—Finnegan, Henderson, Farabow, Garrett & Dunner

[57] ABSTRACT

An elastic rotation body contacts with the surface of a developer carrier and rotates in the same direction as that of the carrier. A bias voltage for forming an electric field for attracting a developer on the carrier which has passed through a development station is applied to the elastic rotation body. The elastic rotation body is disposed at the edge portion of an opening of a device housing in the downstream of the development station, in such a manner that a part of the surface of the elastic rotation body is exposed to the outside of the device housing, and the clearance between the rotation body and the electrostatic latent image holder is greater than the clearance between the developer carrier and the electrostatic latent image holder. A developer removing member for returning the developer on the elastic rotation body to the interior of the device housing is disposed. The rotation body can prevent the image hysteresis phenomenon from occurring and reduce the toner scattering to a very small degree, without deteriorating the charging property of the developer.

5 Claims, 5 Drawing Sheets

ONE-COMPONENT DEVELOPING DEVICE

BACKGROUND OF THE INVENTION

1. Field of the Invention

This invention relates to a one-component developing device which develops an electrostatic latent image formed on an electrostatic latent image holder in an electrophotographic copying machine, a printer, or the like, using a one-component developer (hereinafter, sometimes referred to as "toner").

2. Discussion of the Related Art

One-component developing devices disclosed in Japanese Patent Unexamined Publication No. Sho. 47-13088 and Japanese Utility Model Unexamined Publication No. Sho. 53-30339 have the following configuration: As shown in FIG. 5, a one-component developer b supplied from a developer supply roller a or the like is carried on a developer carrier (developing roll) c, and a layer forming member d which is disposed so as to be pressed to the surface of the carrier c contacts with the developer b so that the developer is frictionally electrified and a uniform thin layer of the developer is formed. In a development station A where the developer carrier is in close proximity to an electrostatic latent image holder (photoreceptor drum) e, the developer is selectively transferred to the holder e to develop an electrostatic latent image f. In such one-component developing devices, there arises a problem in that phenomena such as an image hysteresis and a toner scattering from the development station take place. In FIG. 5, g designates a bias power source, p designates a housing of the developing device, and g designates a seal member.

The image hysteresis is a phenomenon in which the developer thin layer is split into two areas, an area which is used in the development of an electrostatic latent image (developing area), and another area which is not used in the development (nondeveloping area), and an image density difference is produced owing to the process of forming the two areas. Specifically, in the developing area, a developer is further supplied onto the carrier and another thin layer is formed by the layer forming member. By contrast, in the nondeveloping area, the same thin layer is passed plural times through the layer forming member without being further supplied with a developer. This produces difference in thickness of a developer thin layer newly formed on the developer carrier (the layer thickness in the developing area is greater by several $\mu$m than that in the nondeveloping area), and also in electrification of the developer (the charging amount of the developer in the developing area is smaller by several $\mu$C/g than that in the nondeveloping area), whereby the density of an image portion corresponding to the nondeveloping area is made lower than that of an image portion corresponding to the developing area. In other words, a so-called ghost in which the image of the developing area in the previous development process appears like a residual image in the image in the present development process is produced.

The toner scattering phenomenon is caused as follows: The developer is forced to fly by a developing electric field formed in the development station where the developer carrier is in close proximity to the latent image holder. A part of the developer transferred to the holder is not used in the development of an electrostatic latent image on the latent image holder and fails to return to the developer carrier. Such a developer is caused to fall or fly out the developing device by its gravity or an air flow which is produced by the rotation of the developer carrier and the latent image holder, thereby contaminating the interior of the copying machine or the like.

In order to prevent the image hysteresis phenomenon from occurring, conventionally, the following one-component developing devices have been proposed.

For example, a developing device in which as shown in FIG. 6 a developer removing roller i is disposed in the upstream of the developer supply roller i in the developing device housing p so as to be in close proximity to the developer carrier c is proposed (Japanese Patent Examined Publication No. Hei. 1-49945). A voltage having a polarity opposite to that of the developer is applied from a power source h to the developer removing roller i. A nonmagnetic one-component developer remaining on the developer carrier c is electrostatically attracted by the removing roller i to be removed from the carrier. The removed developer is returned to the surface of the developer carrier c. In FIG. 6, j designates a recovery blade for returning the developer on the removing roller i to the carrier c.

Another developing device in which as shown in FIG. 8 a peeling member k for peeling off a developer remaining on the developer carrier c is disposed in the developing device housing p has been proposed by the assignee of the application (Japanese Patent Unexamined Publication No. Sho. 62-251771). The developer which has passed through the development station is peeled from the surface of the carrier c by the peeling member k.

Furthermore, a device in which an electrode roll which rotates in the forward direction without contacting with the developer carrier is disposed in the upstream of the layer forming member in the developing device housing has been proposed (Japanese Patent Unexamined Publication No. Hei. 2-127669). The developer which has passed through the development station and remains on the carrier is removed therefrom by the electrode roll.

However, these developing devices which have been proposed in order to prevent the image hysteresis phenomenon from occurring have problems as described below. In the case where the removing roller i is employed, the one-component developer which has been removed once from the carrier c is returned as it is to the carrier c. When a process of copying an image P shown in FIG. 7(*a*) is continuously conducted on several tens sheets and thereafter a process of copying another image Q is conducted, the particle diameter of the toner on the portion of the developer carrier which corresponds to the image area x used in the process of copying the image P differs from that of the toner on the portion of the developer carrier which corresponds to the nonimage area y. More specifically, the particle diameter of the toner on the portion of the developer carrier which corresponds to the nonimage area y is somewhat smaller than that of the toner on the portion of the developer carrier which corresponds to the image area x. As a result, there arises a problem in that the image hysteresis appears in which as shown in FIG. 7(*b*) the density of the image portion corresponding to the nonimage area y is lower than that of the image portion corresponding to the image area x.

In the case where the peeling member k is employed, additives and the like which are added to the developer are not removed from the developer carrier c but caused to adhere thereto by the sliding contact of the peeling member k, thereby contaminating the surface of the developer carrier c. As shown in FIG. 9, the developer immediately after the removal process conducted by the operation of the peeling member k has an impaired rise of the charging property (the charging amount is reduced) as compared with that which has not yet passed through the peeling member k. These produce problems in that fogging easily occurs in the nonimage area (background), and that with the elapse of time the developer itself is deteriorated by the repeated sliding contacts between the developer and the peeling member k.

The inventors experimentally constructed a developing device in which the electrode roll is employed, and conducted experiments using this developing device. As a result, it was noted that, since the electrode roll is disposed inside the device housing, the developer removed by the electrode roll is mixed with the developer stored in the developer storage, thereby producing a problem in that the effect of the image hysteresis depends on the toner amount in the housing.

Any of these proposed developing devices cannot attain the effect of preventing the above-mentioned toner scattering phenomenon from occurring.

As a one-component developing device which can prevent the toner scattering phenomenon from occurring, for example, a developing device in which a toner scattering prevention plate is disposed in the downstream of the development station in the device housing p as shown in FIG. 10 has been proposed (Japanese Patent Unexamined Publication No. Hei. 4-100073).

However, the proposed device has problems in that, although the amount is small, the developer is transported to the outside of the device through a gap between the prevention plate 1 and the electrostatic latent image holder e, by an air flow due to the rotation of the holder e, and that the developer adheres to the front end of the prevention plate l to be accumulated thereon and therefore the accumulated developer is transported to the outside of the device.

As described above, there is no developing device in which both the image hysteresis phenomenon and the toner scattering phenomenon can be prevented from occurring.

SUMMARY OF THE INVENTION

The invention has been made in view of the circumstances described above. It is an object of the invention to provide a one-component developing device in which both the image hysteresis phenomenon and the toner scattering phenomenon can be prevented from occurring without impairing the charging property of a developer, which is compact in size, and which can be manufactured at a low cost.

In attaining the above object, the invention provides a one-component developing device including: a developer carrier, which is rotatably disposed in an opening formed in a device housing and at a position opposing an electrostatic latent image holder, for transporting a one-component developer to a development station which is in close proximity to the electrostatic latent image holder; a layer forming member, which is disposed to contact with the developer carrier, for forming a thin layer of the developer on the developer carrier, a predetermined charge being supplied to the thin layer, and the developer of the thin layer being transferred onto the electrostatic latent image holder at the development station, thereby developing an electrostatic latent-image; an elastic rotation body which rotates in the same direction as that of the developer carrier, and to which a bias voltage for forming an electric field for attracting the developer on the carrier is applied, the elastic rotation body being disposed at an edge portion of the opening of the device housing in the downstream of the development station in such a manner that a part of a surface of the elastic rotation body is exposed to the outside of the device housing, and that a clearance between the rotation body and the electrostatic latent image holder is greater than a clearance between the developer carrier and the electrostatic latent image holder; and developer removing means for returning the developer on the elastic rotation body to the inside of the device housing.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

Figure 1:
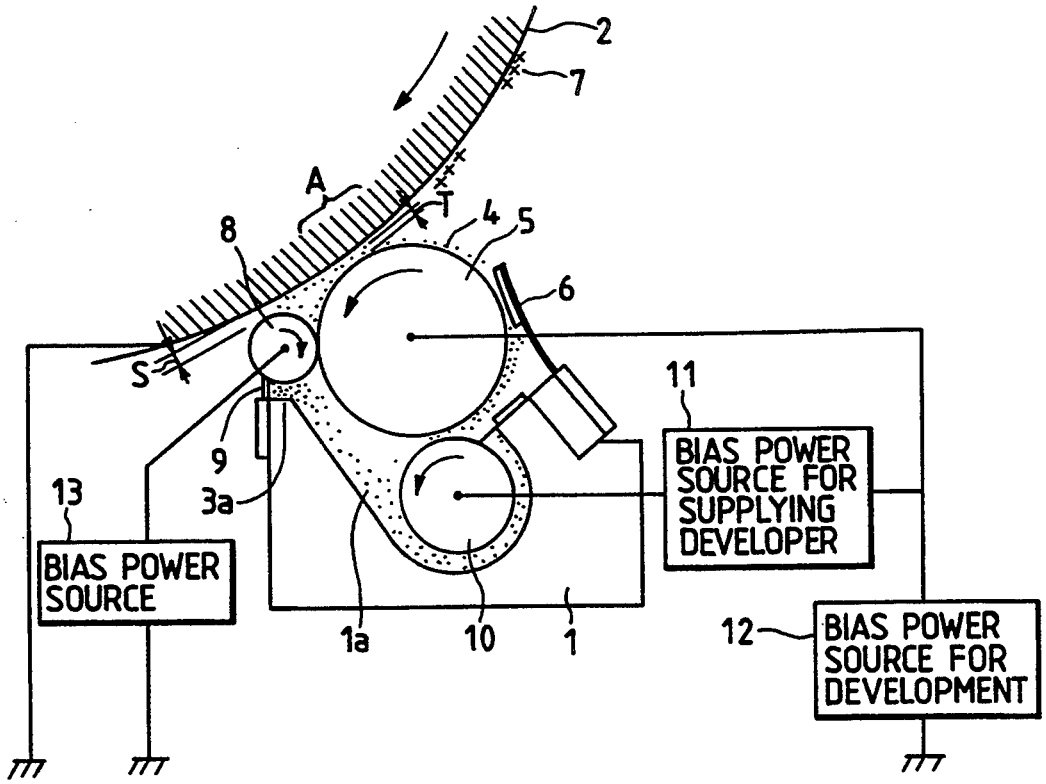
FIG. 1 is a view illustrating a one-component developing device which is a first embodiment of the invention.

As exemplified in FIG. 1, in the one-component developing device of the invention, a layer forming member 6 contacts with a developer carrier 5 which is rotatably disposed in an opening 3 formed in a device housing 1 and at a position opposing an electrostatic latent image holder 2, and which transports a one-component developer 4 to a development station A in close proximity to the electrostatic latent image holder 2, whereby a thin layer of the developer 4 is formed on the developer carrier 5 by the layer forming member 6 and a predetermined charge is supplied to the thin layer. The developer 4 of the thin layer is transferred onto the electrostatic latent image holder 2 at the development station A, thereby developing an electrostatic latent image 7.

The one-component developing device is characterized in that an elastic rotation body 8 which contacts with the surface of the developer carrier 5 and rotates in the same direction as the developer carrier, and to which a bias voltage for forming an electric field for attracting the developer 4 on the carrier 5 is applied is disposed at the edge portion 3*a* of the opening of the device housing 1 in the downstream of the development station A, in such a manner that a part of the surface of the elastic rotation body 8 is exposed to the outside of the device housing 1, and the clearance S between the rotation body 8 and the electrostatic latent image holder 2 is greater than the clearance T between the developer carrier 5 and the electrostatic latent image holder 2, and a developer removing member 9 for returning the developer 4 on the elastic rotation body 8 to the inside of the device housing 1 is disposed.

In the one-component developing device of the invention having the above-mentioned configuration, the bias voltage $V_1$ applied to the elastic rotation body 8, and the bias voltage $V_2$ applied to the developer carrier 5 satisfy the following conditional expressions (1) and (2):

$$500\ (V) \geqq |V_{2(DC)} - V_{1(DC)}| \quad (1)$$

$$1000\ (V) \geqq |(V_{2(DC)} - V_{1(DC)}) \pm 0.5(V_{2(PP} - V_{1(PP)})| \quad (2)$$

wherein V in parentheses indicates the unit of voltage, DC indicates a DC component of a bias voltage, and PP indicates a peak-to-peak voltage of an AC component.

In the one-component developing device of the invention having the above-mentioned configuration, when the clearance between the rotation body 8 and the electrostatic latent image holder 2 is S (mm), the AC component $V_{1(PP)}$ (kV) of the bias voltage applied to the elastic rotation body 8 satisfies the following conditional expression (3):

$$V_{1(PP)} \leqq 1.2S + 1.8 \quad (3)$$

In the above-mentioned configuration, the elastic rotation body 8 which contacts with the surface of the developer carrier 5 and rotates so that the surfaces of the two elements move in the same direction is disposed in such a manner that a part of the surface of the rotation body is exposed to the outside of the device housing 1 so as to be in proximity to the electrostatic latent image holder 2 as close as possible, at least in the range where the clearance S between the rotation body and the electrostatic latent image holder is greater than the clearance T between the developer carrier 5 and the electrostatic latent image holder 2. The developer carrier 5 and the electrostatic latent image holder 2 rotate in the directions of the arrows shown in FIG. 1.

The elastic rotation body 8 or elastic roll has a configuration in which an aluminum or stainless steel round bar of about 3 to 20 mmϕ(the diameter is about 3 to 20 mm; "mmϕ" indicates that the diameter is measured and the measuring unit is "mm") is covered by an elastic member such as EPDM and the surface is coated by PFA. Alternatively, the elastic roll may be a conductive elastic roll having a surface layer made of an electrically conductive member.

The peripheral speed of the elastic roll is 0.1 to 2.0 times, preferably 0.5 to 1.5 times that of the developer carrier. In the case of the conductive elastic roll, the peripheral speed is 0.5 to 1.5 times, preferably 1.0 time that of the developer carrier. The contact depth of the elastic roll with respect to the developer carrier is within the range of about 0 to 2.0 mm. In the view point of the prevention of the increase of the rotation torque and the reduction of stress imposed to the developer, it is preferable to set the contact depth to be 0.2 to 0.4 mm. The clearance S between the elastic roll and the electrostatic latent image holder is within the range of about 0.02 to 1.0 mm, preferably 0.3 to 0.7 mm.

A bias voltage for forming an electric field for attracting the developer 4 remaining on the developer carrier 5 after passing through the development station A, i.e., an AC bias voltage to which a DC voltage having a polarity opposite to that of the developer on the developer carrier is superposed is applied to the elastic rotation body 8. The level of the bias voltage is adequately set so that the developer and additives remaining on the developer carrier can be more efficiently attracted to the elastic rotation body and it can be assured to subsequently forming the developer thin layer in a satisfactory manner without adversely affecting the charging property of the developer.

In experiments conducted by the inventors, it was confirmed that the charging property of the developer is made broad (that is, a phenomenon occurs in which the charging amount is changed or scattered and the distribution width of the charging property is widened), depending on the potential difference between the elastic rotation body 8 and the developer carrier 5 which is produced by the applied bias voltage, resulting in that the subsequent formation of the developer thin layer cannot be conducted in a satisfactory manner. From the above, it is preferable to set the bias voltage $V_1$ applied to the elastic rotation body to be a level which satisfies the conditional expressions (1) and (2) in conjunction with the bias voltage $V_2$ applied to the developer carrier 5.

Specifically, the conditional expression (1) indicates the bias voltage $V_1$ (DC component) must be determined so that the level of the DC component which becomes the potential difference between the elastic rotation body and the developer carrier is equal to or less than 500 V at least. The conditional expression (2) indicates the bias voltage $V_1$ (DC and AC components) must be determined so that the total of the DC component and the AC component (of a half wave) which becomes the potential difference is equal to or less than 1,000 V at least. When the bias voltage $V_1$ fails to satisfy the conditional expressions (1) and (2) (that is, the potential difference between the elastic rotation body and the developer carrier is higher than the required level), therefore, the charging property of the developer becomes broad so that the subsequent formation of the developer thin layer is disturbed or cannot be conducted satisfactorily.

Regarding the bias voltage $V_1$, it is preferable to set its level to a value, so that the application of the bias voltage $V_1$ can prevent the phenomenon in which the developer 4 that has been transferred once to the electrostatic latent image holder 2 is attracted to be removed therefrom by the electric field formed between the elastic rotation body 8 and the holder 2 and the developed image is disturbed, from occurring.

Figure 2:
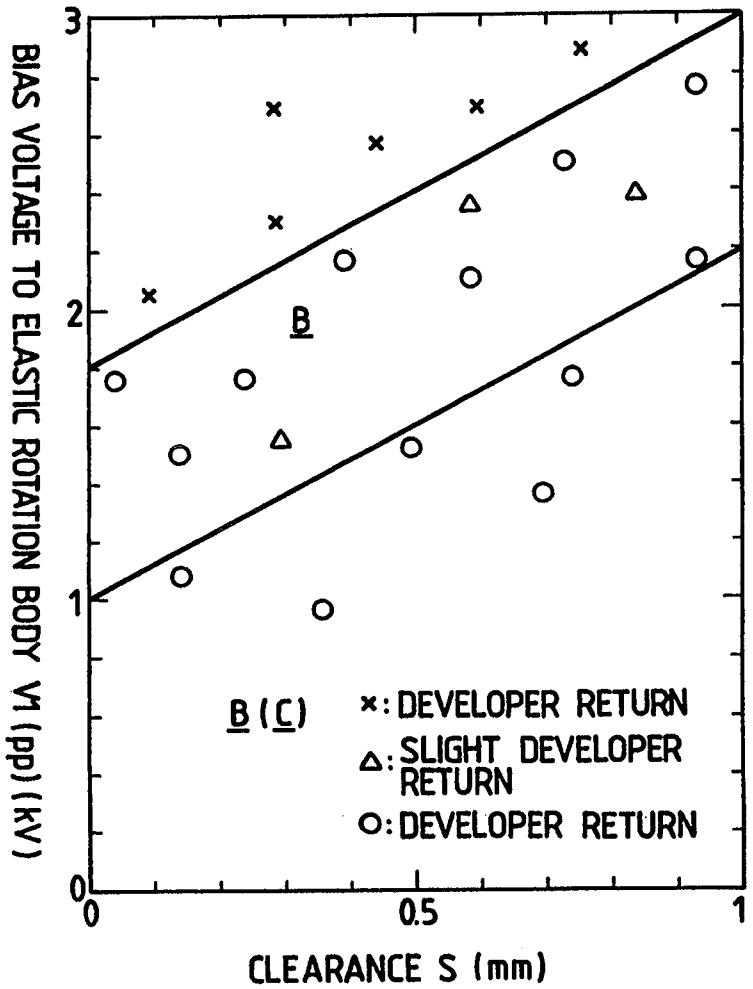
FIG. 2 is a correlation diagram of a bias voltage $V_1$ and a clearance S with respect to the developer returning phenomenon.
Figure 5:
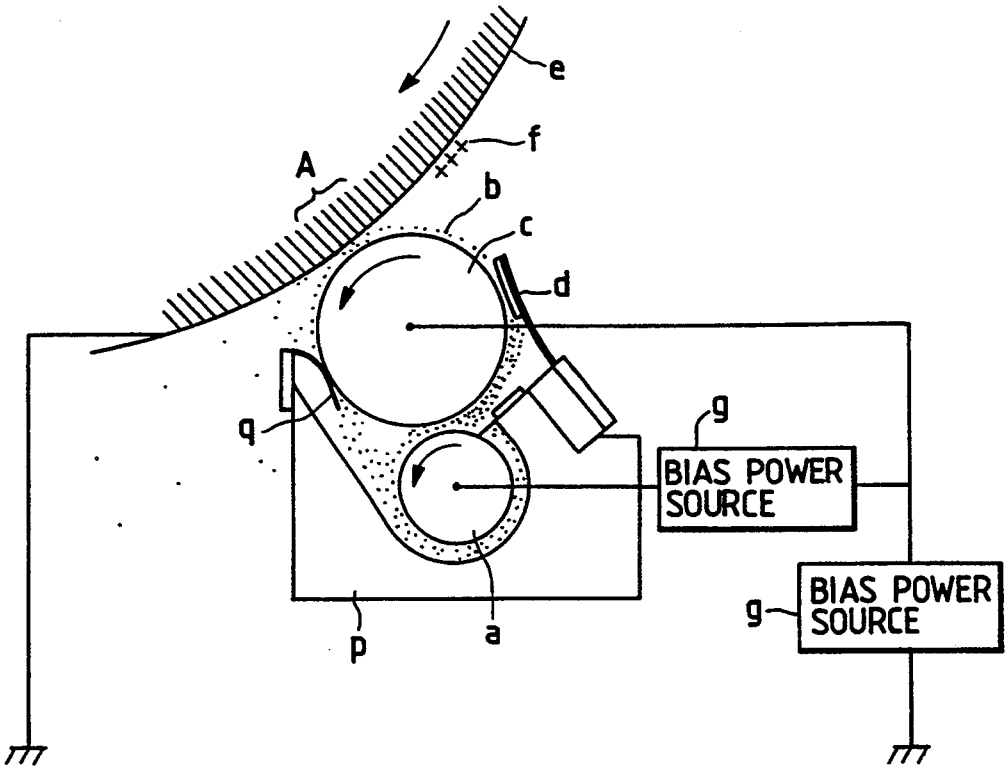
FIG. 5 PRIOR ART
FIG. 5 is a view illustrating a conventional one-component developing device.
Figure 6:
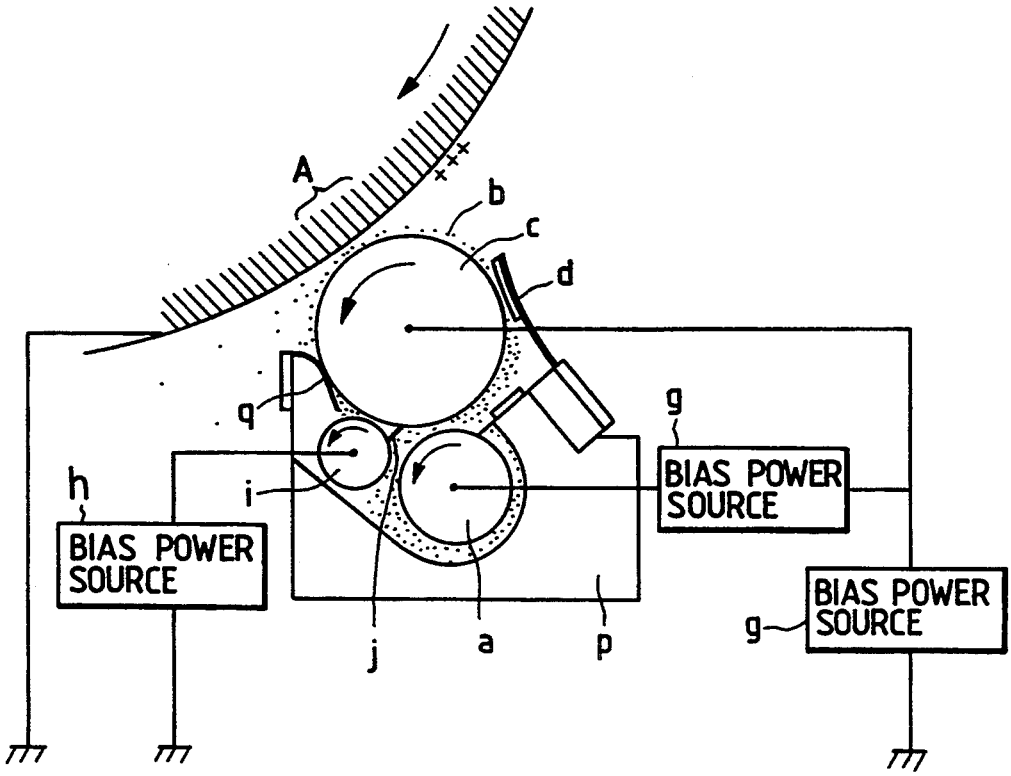
FIG. 6 PRIOR ART
FIG. 6 is a view illustrating an example of a conventional device in which the image hysteresis phenomenon is prevented from occurring.
Figure 7A:
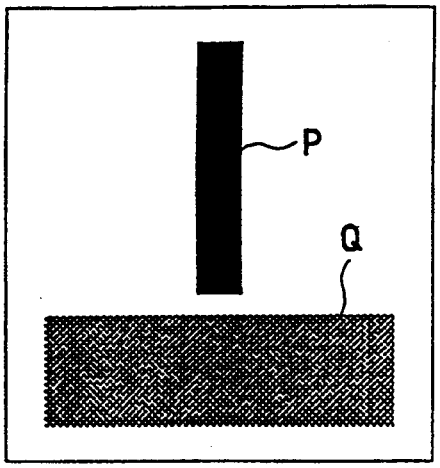
FIGS. 7(*a*) and 7(*b*) are diagrams for explaining the image hysteresis phenomenon.
Figure 7B:
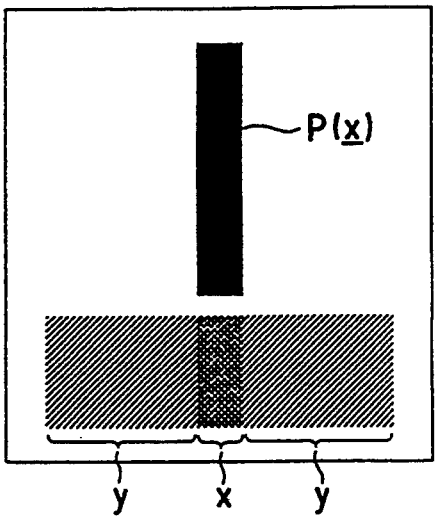
Figure 8:
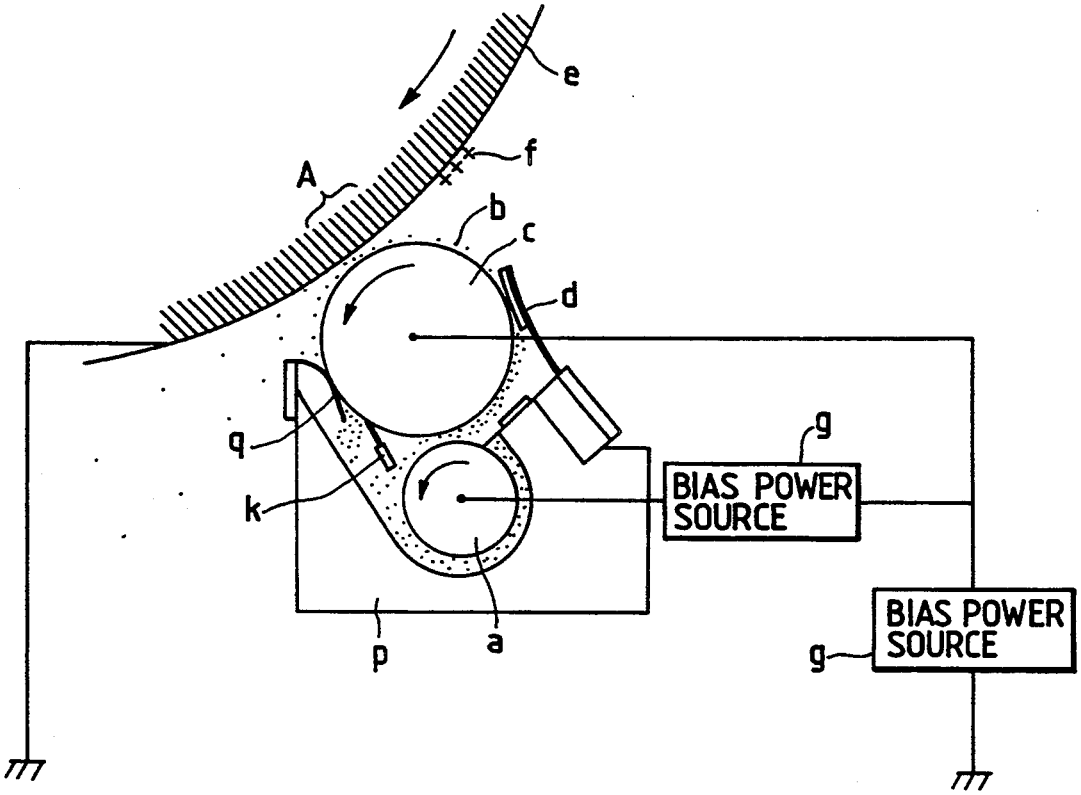
FIG. 8 PRIOR ART
FIG. 8 is a view illustrating another example of the conventional device in which the image hysteresis phenomenon is prevented from occurring.
Figure 9:
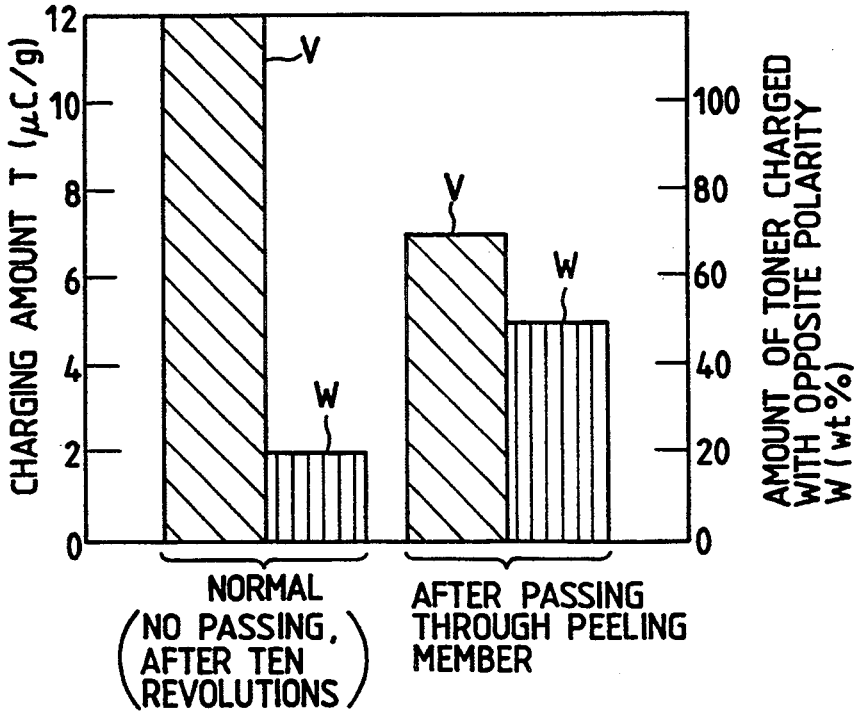
FIG. 9 is a graph showing charging properties of a developer in the device of FIG. 8.
Figure 10:
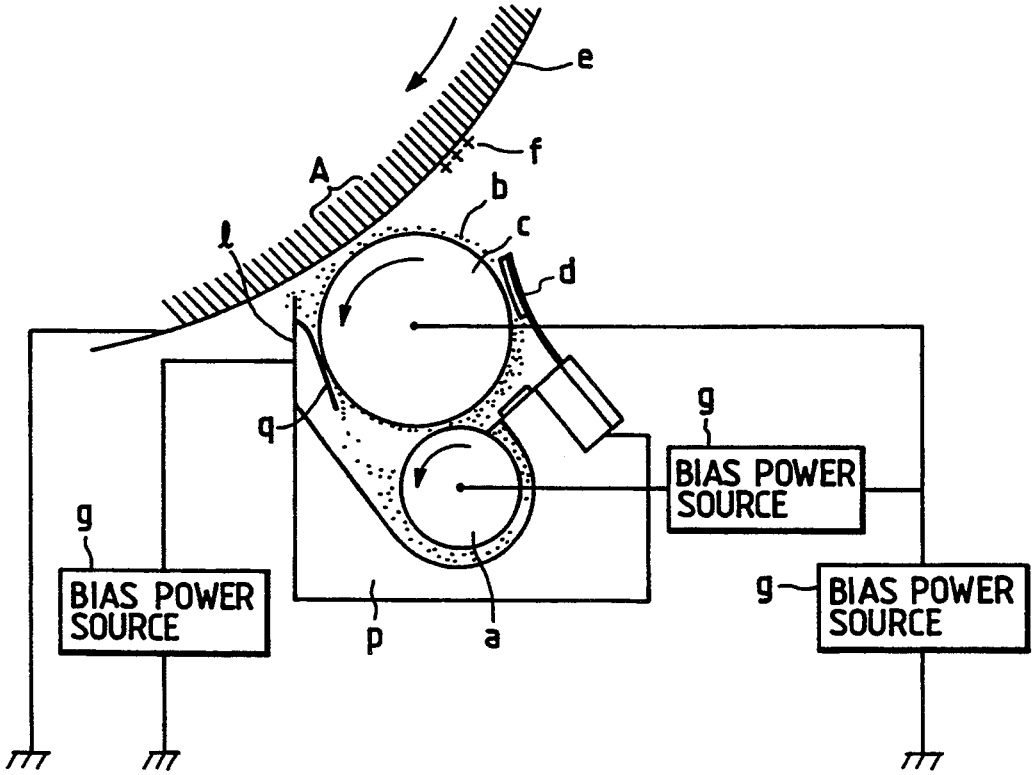
FIG. 10 PRIOR ART
FIG. 10 is a view illustrating an example of a conventional device in which the toner is prevented from scattering.

With respect to the phenomenon in which a developer is returned from an electrostatic latent image holder to an elastic rotation body, generally, the results shown in FIG. 2 are obtained when the AC component $V_{1(PP)}$ (kV) of the bias voltage $V_1$ and the clearance S (mm) between the elastic rotation body and the electrostatic latent image holder which are the main factors of the developer returning phenomenon are changed. Judging from these results, in order to prevent the developer returning phenomenon from occurring, the AC component $V_{1(PP)}$ of the bias voltage $V_1$ is set so as to be at least in region B ($V_{1(PP)} \leqq 1.2S+1.8$) of the figure, depending on the clearance S, and preferably in region C ($V_{1(PP)} \leqq 1.2S+1.0$) in view of the developer returning which is caused by the run-out of the rotation bodies.

In the above-mentioned configuration, the developer removing member 9 is disposed in order to remove the developer on the elastic rotation body 8 which has beer recovered from the developer carrier, and to efficiently and accurately return the removed developer to the inside of the device housing. The developer removing member consists of, for example, a plate spring of stainless steel or a blade of urethane rubber which has a thickness of about 0.05 to 0.15 mm. The developer removing member is disposed in such a manner that one end is fixed to the housing or the like and the other end contacts with the surface of the elastic rotation body.

The other elements in the above-mentioned configuration may be structured as described below.

The developer carrier 5 usually consists of a roll of 5 to 40 mmϕ. More specifically, the developer carrier is structured by cutting a round bar or pipe of aluminum or stainless steel, and conducting a machining process or a chemical corrosion process such as sand blasting, liquid honing, or emery polishing on the circumferential surface to obtain a surface roughness of Ra=about 0.1 to 1.0 μm. Alternatively, the developer carrier may be structured by cutting a round bar or pipe of aluminum or stainless steel, forming a layer of semiconductor such as phenol resin on the circumferential surface, and conducting a mechanical polishing process such as emery polishing on the surface to obtain a surface roughness of Ra=0.1 to 1.0 μm, preferably Ra=0.2 to 0.4 μm. An aluminum roll which is obtained by conducting a mechanical polishing process and anodization may be used as the carrier. In the case where the carrier is provided with a semiconductor layer, the volume resistivity of the surface layer of the carrier in the thickness direction is about $10^5$ to $10^{12}$ Ωcm.

The developer carrier 5 rotates in the direction of the arrow in FIG. 1 at a speed of rotation of 100 to 300 rpm. The bias voltage for development is applied to the developer carrier 5. Generally, the bias voltage is an AC bias voltage (frequency: 1 to 5 kHz) of 1,000 to 4,000 $V_{PP}$ to which a DC voltage of −50 to −400 V is superposed, and preferably an AC bias voltage having a peak value $V_{peak}$ which is in the range of 4 to 7 V/μm when divided by the clearance S between the rotation body 8 and the holder 2, and a frequency of 2.5 to 4.0 kHz. The clearance T between the carrier 5 and the electrostatic latent image holder 2 which is made of an Se photosensitive material or an organic photosensitive material is usually within the range of 100 to 400 μm, and preferably about 150 to 300 μm.

The layer forming member 6 includes a stainless steel plate spring of a thickness of about 0.03 to 0.3 mm which is fixed at its one end to the housing or the like, and a contacting member such as Si rubber or EPDM rubber which is adhered to the other end of the spring by vulcanizing. The layer forming member 6 is disposed in the downstream of a developer supply member 10 so as to contact with the surface of the carrier 5 at a contact pressure of about 20 to 200 g/cm, whereby the developer supplied to the carrier is formed into a thin layer of about 5 to 30 μm and provided with a charge of about 2 to 20 μC/g.

The developer supply member 10 consists of an aluminum or stainless steel pipe of 10 to 20 mmϕ and having a thickness of 1 to 4 mm. Several openings are formed on the peripheral face of the pipe. The supply member is located so as to oppose the developer carrier with a gap of about 0.5 to 2.0 mm, and rotated at a peripheral speed which is about 1 to 5 times that of the carrier. A DC bias voltage of about 200 to 1,000 V is supplied between the supply member 10 and the carrier 5 in such a manner that the supply member has the same polarity as that of the developer. In order to prevent the developer from filing the surface of the supply member, Mylar or the like of about 50 to 500 μm may be contacted with the surface.

The one-component developer 4 used in the present device may be magnetic or nonmagnetic, and may be a color developer or an encapsulated developer as required. For example, the developer may be produced by dispersing a pigment such as carbon, and a polarity control agent such as metallized azo dye into thermoplastic resin such as styrene resin, acrylic resin, or polyester resin, pulverizing and classifying to granulate into a particle diameter of 5 to 20 μm, and adding a charge control agent to the surface. A useful charge control agent is silica, alumina, titanium, or the like which undergoes a hydrophobic process and which is in the form of fine particles having a diameter of 0.1 μm or less. Preferably, the charge control agent is hydrophobic silica.

The developer is supplied from, for example, a developer storage box which is disposed outside the device housing, to the inside of the housing.

According to the developing device having the above-mentioned configuration, in the substantially same manner of a conventional developing device of this type, the one-component developer 4 is supplied onto the developer carrier 5 by the developer supply member 10, and frictionally electrified and formed into a uniform thin layer by the layer forming member 6. Thereafter, the developer is transferred to the development station A, and selectively transferred therein to the electrostatic latent image holder 2 to develop the electrostatic latent image 7, thereby conducting the developing process. After the developer passes through the development station A, the developing device operates as described below.

An electrostatic attracting force which attracts the developer on the developer carrier is generated in the elastic rotation body 8 by the bias voltage. Furthermore, an air flow directed to the inside of the device housing is produced between the elastic rotation body 8 and the developer carrier 5 which rotate in the same direction, and an air flow due to the rotation of the elastic rotation body 8 itself is produced. Accordingly, the developer flying from the development station is introduced into the device housing by the air flow between the elastic rotation body and the developer carrier, or attracted onto the elastic rotation body and then transferred into the housing. The developer which is disposed to be transported to the outside of the developing device by an air flow due to the rotation of the electrostatic latent image holder is caused to flow in the housing by the air flow produced by the elastic rotation body, or attracted onto the elastic rotation body and then transferred into the housing. In this way, the toner is prevented from scattering to the outside of the developing device.

The bias voltage for attracting the developer on the developer carrier is applied to the elastic rotation body 8. Furthermore, the elastic rotation body 8 rotates in the same direction as that of the developer carrier while contacting with it. Therefore, the developer and additives remaining on the developer carrier are surely attracted onto the elastic rotation body to be removed from the developer carrier. This allows the surface of the developer carrier's 5 that has passed through the development station, to be temporarily kept to a clean state in which any developer does not exist irrespective of the image area and the nonimage area. Thereafter, the surface is subjected to the sure supply of a fresh developer, and the thin film formation and the frictional electrification are conducted by the layer forming member, whereby the image hysteresis phenomenon is eliminated. This effect is further ensured by defining the level of the bias voltage $V_1$ which is applied to the elastic rotation body.

Since the elastic rotation body 8 is separated from the electrostatic latent image holder at least by a distance which is greater than the distance between the electrostatic latent image holder and the developer carrier, the electrostatical attraction force due to the elastic rotation body does not cause the developer which has been transferred once onto the holder, to be removed therefrom. This effect is further ensured by defining the level of the AC component of the bias voltage which is applied to the elastic rotation body.

As described above, the developer remaining on the developer carrier is recovered by the elastic rotation body. Therefore, additives and the like of the developer can surely be attracted and removed therefrom, and the charging property of the developer is not adversely affected.

Hereinafter, the invention will be described in more detail by illustrating its first and second embodiments.

In the first embodiment, as shown in FIG. 1, reference numeral 1 designates a device housing, 2 designates a negatively charging organic photoreceptor drum which functions as the electrostatic latent image holder, 3 designates an opening formed at a position opposing the photoreceptor drum 2, and 4 designates a polyester nonmagnetic one-component color toner which is the one-component developer. Reference numeral 5 designates a developing roll (24 mmϕ, $10^6$ Ωcm) on which a phenol resin layer is formed and which functions as the developer carrier, 6 designates a layer forming member made of a plate spring (SUS303) having a thickness of 0.12 mm and one end to which EPDM rubber is attached, and 7 designates an electrostatic latent image. Reference numeral 8 designates an elastic roll (10 mmϕ) in which EPDM rubber is coated by PFA and which functions as the elastic rotation body, 9 designates a scraper which functions as the developer removing member, and 10 designates a developer supply roll made of a stainless steel roll (19 mmϕ) having a plurality of openings which are formed on the peripheral face.

Furthermore, character A designates a development station, S designates a clearance between the elastic roll 8 and the photoreceptor drum 2, T designates a clearance between the developing roll 5 and the photoreceptor drum 2, 11 designates a bias power source for supplying the developer and connected to the developer supply roll 10, 12 designates a bias power source for development and connected to the developing roll 5, and 13 designates a bias power source connected to the elastic roll 8.

The developing device which was set to the conditions listed below was installed in a copying machine (test apparatus obtained by modifying FX6800), and then subjected to a print test for a long period of time.

Process speed of photoreceptor drum: 160 mm/sec
Speed of rotation of developing roll: 180 μm
Clearance T: about 200 rpm
Speed of rotation of developer supply roll: 600 rpm
Contact pressure of layer forming member: about 120 gf/cm
Speed of rotation of elastic roll: 430 rpm
Contact depth with respect to developing roll: about 300 μm
Clearance S: about 500 μm
Potential of electrostatic latent image: −100 V
Background potential: −350 V
Bias for development: DC −200 V to which AC 2,400 $V_{PP}$ of 4 kHz is superposed
Bias to elastic roll: DC+100 V to which AC 2,400 $V_{PP}$ of 4 kHz is superposed As a result, even after a copy operation was repeated on about 60,000 sheets, the image hysteresis phenomenon did not occur, the scattering of toner to the outside of the developing device was very small in degree, the formation of the developer thin layer on the developing roll was conducted satisfactorily, and the fogging was not generated.

Then, in the developing device, the DC component $V_{1(DC)}$ and AC component $V_{1(PP)}$ of the bias voltage applied to the elastic roll were adjusted as listed in Table 1 below, and the occurrence of the developer returning phenomenon was inspected. In this inspection, the clearance S between the elastic roll and the photoreceptor drum was 200 μm, the contact depth of the elastic roll with respect to the developing roll was 300 μm, and the bias for development was DC −200 V to which AC 2,400 $V_{PP}$ of 4 kHz was superposed.

Results are shown in Table 1. In the table, o indicates that the developer was not returned, and x indicates that the developer was returned.

TABLE 1

| $V_{1(DC)}$ (V) | $V_{1(PP)}$ (kV) 0.6 | 1.0 | 1.4 | 1.8 | 2.2 | 2.6 |
|---|---|---|---|---|---|---|
| −200 | o | o | o | o | o | o |
| 0 | x | o | o | o | o | o |
| 200 | x | x | o | o | o | o |
| 400 | x | x | x | x | x | x |

As seen from the results listed in Table 1, it was confirmed that, when the bias voltage applied to the elastic roll is set so as to satisfy the conditional expressions (1) and (2), the developer is not returned and the recovery of the developer and additives from the developing roll is conducted by the elastic roll in a satisfactory manner, but, when the bias voltage is set so as not to satisfy the conditional expressions, the developer is returned and a developed image on the photoreceptor drum is disturbed.

Figure 3:
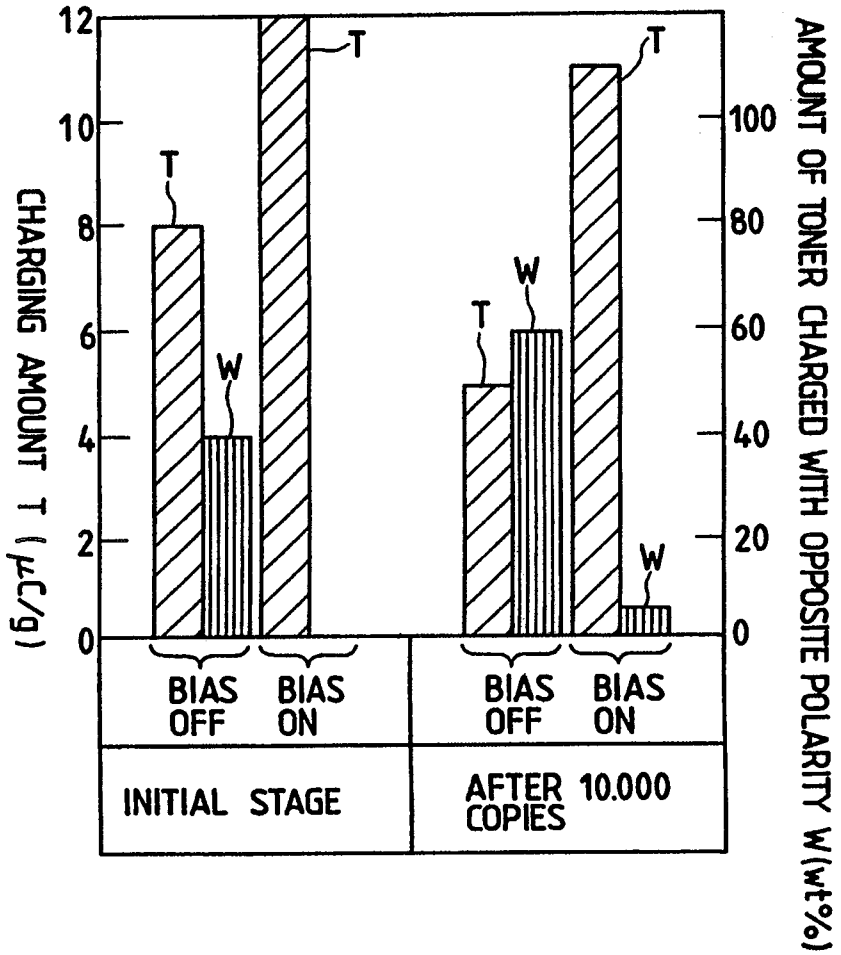
FIG. 3 is a graph showing charging properties of a developer before and after passing through an elastic roll.

The charging property of the developer recovered by the elastic roll to which a bias voltage satisfying the conditional expressions (1) and (2) was checked at the initial stage and after the copy operations of 10,000 sheets. Results are shown in FIG. 3. Results of checking the charging property in the case where no bias voltage was applied to the elastic roll are also shown for reference in FIG. 3.

As a result, it was confirmed that the charging property of the developer recovered by the elastic roll is not impaired (or the amount of a toner charged with the opposite polarity is small), and the excellent charging property is maintained.

Figure 4:
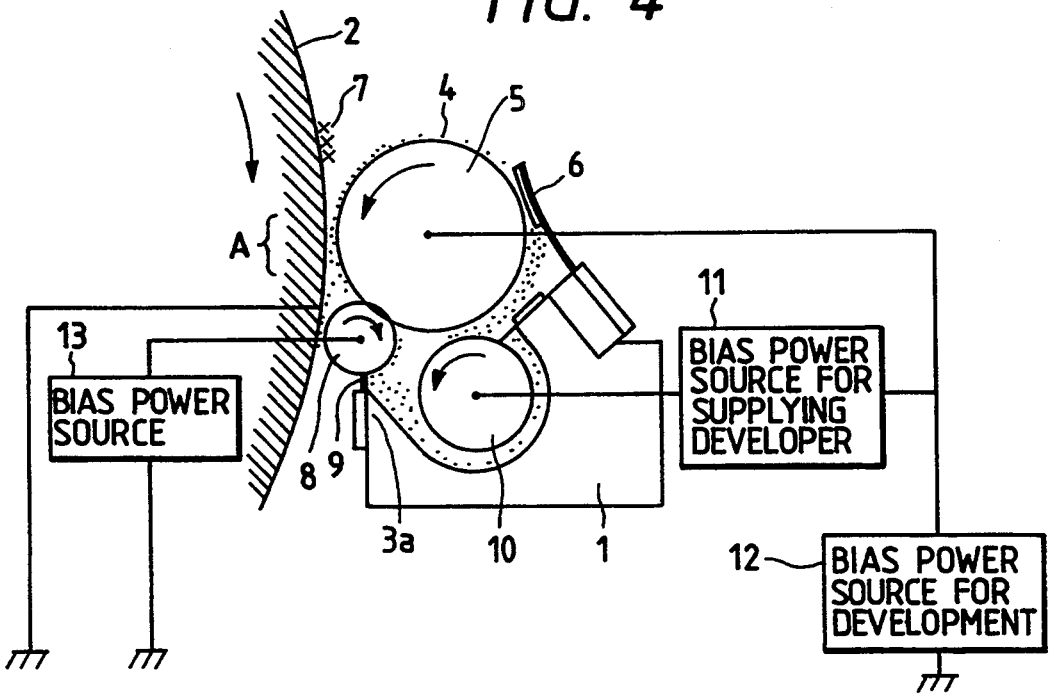
FIG. 4 is a view illustrating an one-component developing device which is a second embodiment of the invention.

FIG. 4 shows a one-component developing device which is the second embodiment of the invention.

The developing device has the same configuration as that of the first embodiment except that the elastic roll 8 is a conductive elastic roll which has a conductive rubber surface layer having a resistivity of $10^5$ Ωcm and a rubber hardness of 50 deg., that the elastic roll 8 is located substantially just under (or just under) the development station A so as to contact with the developing roll 5 with a contact depth of 0.1 mm, and rotated at a peripheral speed which is 1.0 time that of the developing roll, and that the bias voltages are set as described below.

A copy test was conducted on the developing device while an AC bias voltage to which a DC voltage of the polarity opposite to that of the toner 4 was superposed was applied to the conductive elastic roll 8 and a DC voltage of the polarity opposite to that of the toner 4 was applied to the photoreceptor drum 2. As a result, it was possible to conduct copy operations satisfactorily in which the image hysteresis phenomenon was not observed, and the scattering of toner from the development station was very small in degree.

The developing device of this embodiment may be operated under other conditions that no bias voltage is applied to the conductive elastic roll 8, a DC voltage of the polarity opposite to that of the toner 4 is applied to the developing roll 5, and a DC bias voltage of the polarity opposite to that of the toner 4 or an AC bias voltage to which a DC voltage is superposed is applied to the photoreceptor drum 2.

In the case where the conductive elastic roll 8 is employed, it is critical to set the resistivity of the conductive member to be usually $10^4$ to $10^{10}$ Ωcm. When the resistivity is not within this range, a bias leak occurs or it is impossible to satisfactorily achieve the effect of the electric field. When an AC bias voltage to which a DC voltage is superposed is applied to the developing roll 5, particularly, it is preferable to set the resistivity of the conductive member to be $10^7$ to $10^{10}$ Ωcm. When conductive rubber is used as the conductive member, it is preferable to set the rubber hardness to be within the range of 30 to 70 deg.

When such a conductive elastic roll is used, a toner remaining on the developing roll 5 which has passed through the development station can be removed easily. As shown in FIG. 4, the conductive elastic roll is partly exposed from the housing 1 so as to be located substantially just under (or just under) the development station A. In this configuration, the elastic roll can function as a seal member.

As described above, according to the invention, the image hysteresis phenomenon can be eliminated and the toner scattering can be reduced to a very small degree without impairing the charging property of the developer. Furthermore, also additives of the developer, and the like can surely be removed from the developer carrier, and no stress is imposed to the developer so as to prevent the developer from deteriorating. Since the developing device of the invention has a configuration in which the elastic rotation body is disposed at the edge portion of the opening of the device housing in such a manner that a part of the surface of the rotation body is exposed to the outside, it is not required to secure an extra space in the developing device, unlike a conventional device having a housing in which parts for preventing the image hysteresis phenomenon from occurring are disposed. Accordingly, the device of the invention can be constructed at a reduced size and manufactured at a low cost.

When the device of the invention is applied to a copying machine or the like, therefore, the copy quality and the reliability of the machine can remarkably be improved.

What is claimed is:

1. A one-component developing device comprising:

a developer carrier, which is rotatably disposed in an opening formed in a device housing and at a position opposing an electrostatic latent image holder, for transporting one-component developer to a development area in which said developer carrier faces said electrostatic latent image holder with a first clearance;

a layer forming member, which is disposed to contact with said developer carrier, for forming a thin layer of the developer on said developer carrier, a predetermined charge being supplied to the thin layer, and the developer of the thin layer flying through said first clearance onto the electrostatic latent image holder at the development area based on an electrostatic latent image on said electrostatic latent image holder, thereby developing said electrostatic latent image;

an elastic rotation body which is in contact with said developer carrier and rotates in such a direction that contact surfaces of said elastic rotation body and said developer carrier move in the same direction, which faces said electrostatic latent image holder with a second clearance, and to which a bias voltage for forming an electric field for attracting the developer on said developer carrier is applied, whereby an air flow and electric attraction force caused by said elastic rotation body transfer the developer scattering from said development area into said device housing, said elastic rotation body being disposed at an edge portion of the opening of the device housing in the downstream of the development area in such a manner that a surface of said elastic rotation body is partially exposed to the outside of the device housing, and that said second clearance is greater than said first clearance; and developer removing means for removing the developer on said elastic rotation body inside of the device housing to prevent the developer from scattering outside of the device housing.

2. The one-component developing device according to claim 1, wherein the bias voltage $V_1$ applied to said elastic rotation body, and a bias voltage $V_2$ applied to said developer carrier satisfy the following conditional expressions:

$$500\ (V) \geqq |V_{2(DC)} - V_{1(DC)}|$$

$$1000\ (V) \geqq |(V_{2(DC)} - V_{1(DC)}) \pm 0.5\ (V_{2(PP} - V_{1(PP)})\ |$$

wherein V in parentheses indicates the unit of voltage, DC indicates a DC component of a bias voltage, and PP indicates a peak-to-peak voltage of an AC component.

3. The one-component developing device according to claim 1, wherein, when the clearance between said elastic rotation body and said electrostatic latent image holder is S (mm), an AC component $V_{1(PP)}$ (kV) of the bias voltage applied to said elastic rotation body satisfies the following conditional expression, $V_{1(PP)} \leqq 1.2S + 1.8$.

4. A one-component developing device comprising:

a developer carrier, which is rotatably disposed in an opening formed in a device housing and at a position opposing an electrostatic latent image holder, for transporting one-component developer to a development area in which said developer carrier faces said electrostatic latent image holder with a first clearance;

a layer forming member, which is disposed to contact with said developer carrier, for forming a thin layer of the developer on said developer carrier, a predetermined charge being supplied to the thin layer, and the developer of the thin layer flying through said first clearance onto the electrostatic latent image holder at the development area based on an electrostatic latent image on said electrostatic latent image holder, thereby developing said electrostatic latent image;

an elastic rotation body which is in contact with said developer carrier and rotates in such a direction that contact surfaces of said elastic rotation body and said developer carrier move in the same direction, which faces said electrostatic latent image holder with a second clearance, and to which a bias voltage for forming an electric field for attracting the developer on said developer carrier is applied, whereby an air flow and electric attraction force caused by said elastic rotation body transfer the developer scattering from said development area into said device housing, said elastic rotation body being disposed at an edge portion of the opening of the device housing in the downstream of the development area in such a manner that a surface of said elastic rotation body is partially exposed to the outside of the device housing; and developer removing means for removing the developer on said elastic rotation body inside of the device housing to prevent the developer from scattering outside of the device housing.

5. A one-component developing device comprising:

a developer carrier, which is rotatably disposed in an opening formed in a device housing and at a position opposing an electrostatic latent image holder, for transporting one-component developer to a development area in which said developer carrier faces said electrostatic latent image holder with a first clearance;

a layer forming member, which is disposed to contact with said developer carrier, for forming a thin layer of the developer on said developer carrier, a predetermined charge being supplied to the thin layer, and the developer of the thin layer flying through said first clearance onto the electrostatic latent image holder at the development area based on an electrostatic latent image on said electrostatic latent image holder, thereby developing said electrostatic latent image;

an elastic rotation body which is in contact with said developer carrier and rotates in such a direction that contact surfaces of said elastic rotation body and said developer carrier move in the same direction, which faces said electrostatic latent image holder with a second clearance, and to which a bias voltage for forming an electric field for attracting the developer on said developer carrier is applied, whereby an air flow and electric attraction force caused by said elastic rotation body transfer the developer scattering from said development area into said device housing, said elastic rotation body being disposed at an edge portion of the opening of the device housing in the downstream of the development area in such a manner that said second clearance is greater than said first clearance; and developer removing means for removing the developer on said elastic rotation body inside of the device housing to prevent the developer from scattering outside of the device housing.

* * * * *